US007942513B2

(12) United States Patent
Kanbe et al.

(10) Patent No.: US 7,942,513 B2
(45) Date of Patent: May 17, 2011

(54) INK CARTRIDGES

(75) Inventors: Tomohiro Kanbe, Nagoya (JP); Shingo Hattori, Nagoya (JP); Hironobu Yamakita, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 799 days.

(21) Appl. No.: 11/961,722

(22) Filed: Dec. 20, 2007

(65) Prior Publication Data

US 2009/0058960 A1 Mar. 5, 2009

(30) Foreign Application Priority Data

Aug. 31, 2007 (JP) ..... 2007-226532

(51) Int. Cl.
*B41J 2/175* (2006.01)

(52) U.S. Cl. ..... 347/86

(58) Field of Classification Search ..... 347/7, 85, 347/86, 87; 137/397, 398
See application file for complete search history.

(56) References Cited

U.S. PATENT DOCUMENTS

| | | | | |
|---|---|---|---|---|
| 6,283,588 | B1 * | 9/2001 | Brandon et al. | 347/86 |
| 6,733,114 | B2 * | 5/2004 | Kobayashi et al. | 347/85 |
| 6,926,396 | B2 * | 8/2005 | Ota et al. | 347/86 |
| 7,188,939 | B1 | 3/2007 | Sasaki | |
| 7,192,128 | B1 | 3/2007 | Hattori et al. | |
| 7,810,916 | B2 * | 10/2010 | Hattori et al. | 347/86 |
| 2003/0184626 | A1 | 10/2003 | Sasaki et al. | |
| 2004/0130583 | A1 | 7/2004 | Seino et al. | |
| 2006/0033789 | A1 | 2/2006 | Sasaki et al. | |
| 2007/0070147 | A1 | 3/2007 | Hattori et al. | |
| 2007/0242114 | A1 | 10/2007 | Kubota et al. | |

FOREIGN PATENT DOCUMENTS

| | | | |
|---|---|---|---|
| CN | 1968818 | A | 5/2007 |
| CN | 101015992 | A | 8/2007 |
| EP | 1097814 | A | 5/2001 |
| EP | 1772270 | A | 4/2007 |
| EP | 1792736 | A | 6/2007 |
| EP | 1849608 | A | 10/2007 |
| EP | 1886821 | A | 2/2008 |
| JP | 2005262564 | A | 9/2005 |
| JP | 2007144808 | A | 6/2007 |

OTHER PUBLICATIONS

European Patent Office, European Search Report for Corresponding European Patent Application No. 08003700, mailed on Jul. 3, 2008.
The State Intellectual Property Office of the People's Republic of China, Notification of First Office Action for Chinese Patent Application No. 200810087258.4 (counterpart to above-captioned patent application), issued Dec. 18, 2009.

* cited by examiner

*Primary Examiner* — Anh T. N. Vo
(74) *Attorney, Agent, or Firm* — Baker Botts L.L.P.

(57) ABSTRACT

An ink cartridge includes a frame, and a film connected to the frame. The frame and the film define an ink chamber therein, and the ink chamber is configured to store ink therein. The ink cartridge also includes a supporting member configured to support the film, and a movable member pivotably coupled to the supporting member. The movable member is configured to selectively move within the ink chamber in a first direction and in a second direction opposite the first direction based on an amount of ink within the ink chamber, and the supporting member, the movable member, and the film are aligned in a particular direction which is perpendicular to the first direction and to the second direction.

9 Claims, 9 Drawing Sheets

INK CARTRIDGES

CROSS-REFERENCE TO RELATED APPLICATION

The present application claims priority from Japanese Patent Application No. JP-2007-226532, which was filed on Aug. 31, 2007, the disclosure of which is incorporated herein by reference in its entirety.

BACKGROUND OF THE INVENTION

1. Field of the Invention

The present invention relates generally to ink cartridges. In particular, the present invention is directed towards ink cartridges which may be used in combination with ink jet printers.

2. Description of Related Art

A known recording apparatus may be configured to detect when an amount of ink within an ink cartridge is less than a sufficient amount of ink. For example, a known ink cartridge may include a float which floats on the ink within the ink cartridge, and a known recording apparatus may include an optical sensor positioned on the side of the ink cartridge. When there is a sufficient amount of ink within the ink cartridge, the float is positioned above the optical sensor, and the light emitted by the optical sensor is not blocked by the float. Nevertheless, as the ink within the ink cartridge is consumed by the recording apparatus, the surface of the ink within the ink cartridge moves downward, which causes the float to also move downward. When the surface of the ink moves down to a predetermined level, the light from the optical sensor is blocked by the float, and the printer determines that there is an insufficient amount of ink within the ink cartridge.

Another known ink cartridge may include an ink container which is configured to store ink and a case which may substantially cover the entire body of the ink container. The ink container may include a frame and a film which may be connected to the frame to cover an opening of the frame and to form an ink chamber. The pressure inside the ink cartridge is less than the atmospheric pressure before the ink cartridge is mounted to the recording apparatus. Consequently, the film may deform inward, which reduces a storage capacity of the ink chamber.

SUMMARY OF THE INVENTION

Therefore, a need has arisen for ink cartridges which overcome these and other shortcomings of the related art. A technical advantage of the present invention is that when the pressure of the ink cartridge is less than atmospheric pressure, the film may not deform inward, such that the storage capacity of the ink chamber may be maintained at a maximum storage capacity.

According to an embodiment of the present invention, an ink cartridge comprises a frame, and at least one film connected to at least a portion of the frame. The frame and the at least one film define an ink chamber therein, and the ink chamber is configured to store ink therein. The ink cartridge also comprises a supporting member configured to support the at least one film, and a movable member pivotably coupled to the supporting member. The movable member is configured to selectively move within the ink chamber in a first direction and in a second direction opposite the first direction based on an amount of ink within the ink chamber, and the supporting member, the movable member, and the at least one film are aligned in a particular direction which is perpendicular to the first direction and to the second direction.

BRIEF DESCRIPTION OF DRAWINGS

For a more complete understanding of the present invention, the needs satisfied thereby, and the objects, features, and advantages thereof, reference now is made to the following description taken in connection with the accompanying drawings.

DETAILED DESCRIPTION OF EMBODIMENTS

Embodiments of the present invention and their features and technical advantages may be understood by referring to FIGS. 1-9, like numerals being used for like corresponding portions in the various drawings.

Figure 1B:
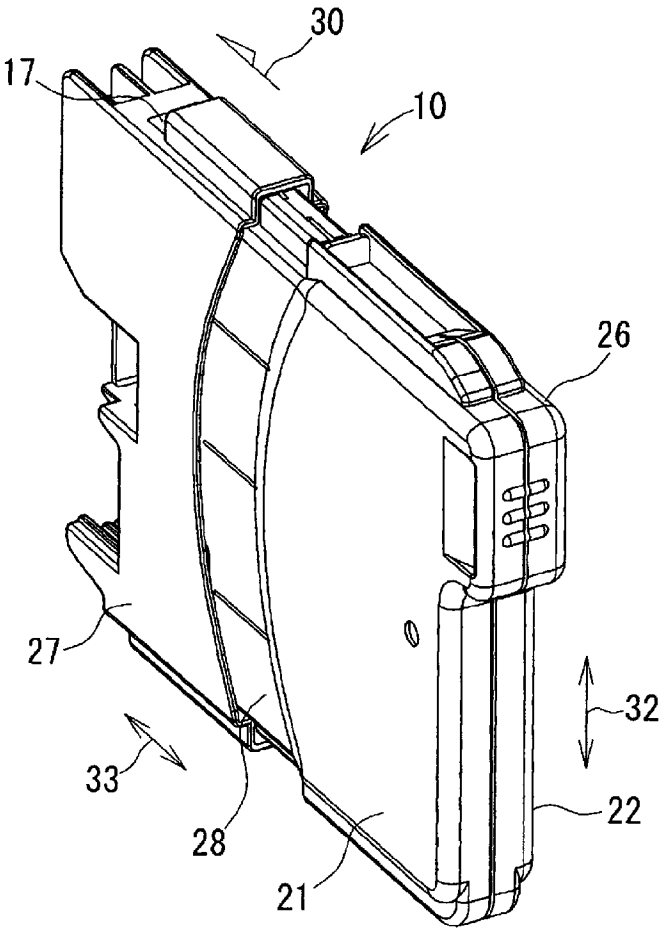
FIGS. 1(A) and 1(B) are a perspective view of a front side and a rear side, respectively, of an ink cartridge, according to the embodiment of the present invention.

Referring to FIG. 1, an ink cartridge 10 may be configured to be removably mounted to an ink jet recording apparatus (not shown), such as an ink jet printer. Specifically, ink cartridge 10 may be mounted in a cartridge storage section (not shown) of the recording apparatus when ink cartridge 10 is inserted in a direction of insertion 30.

Figure 1A:
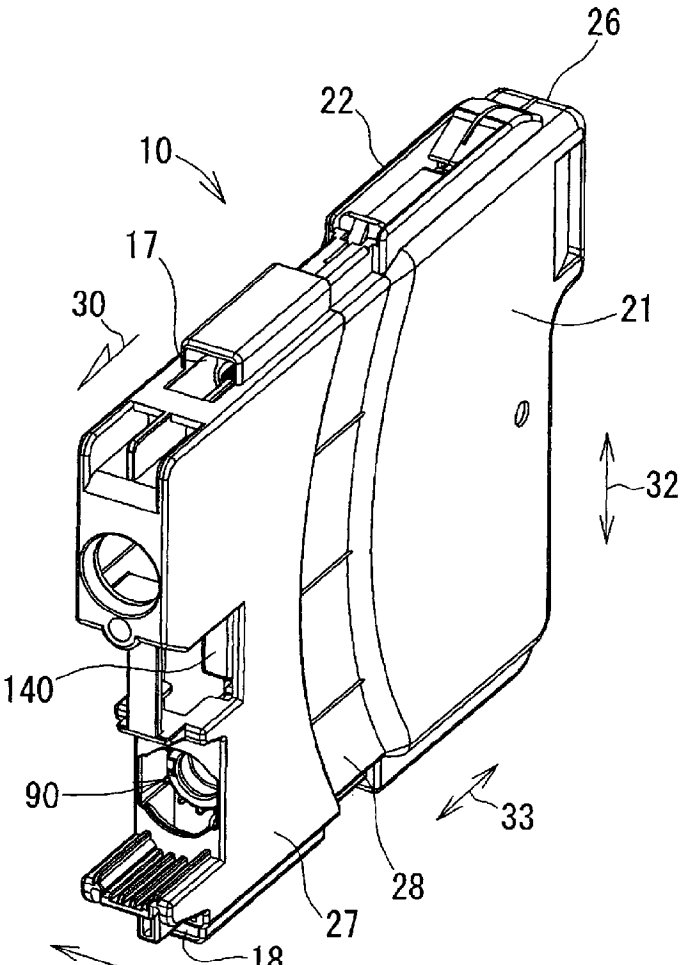
Figure 2:
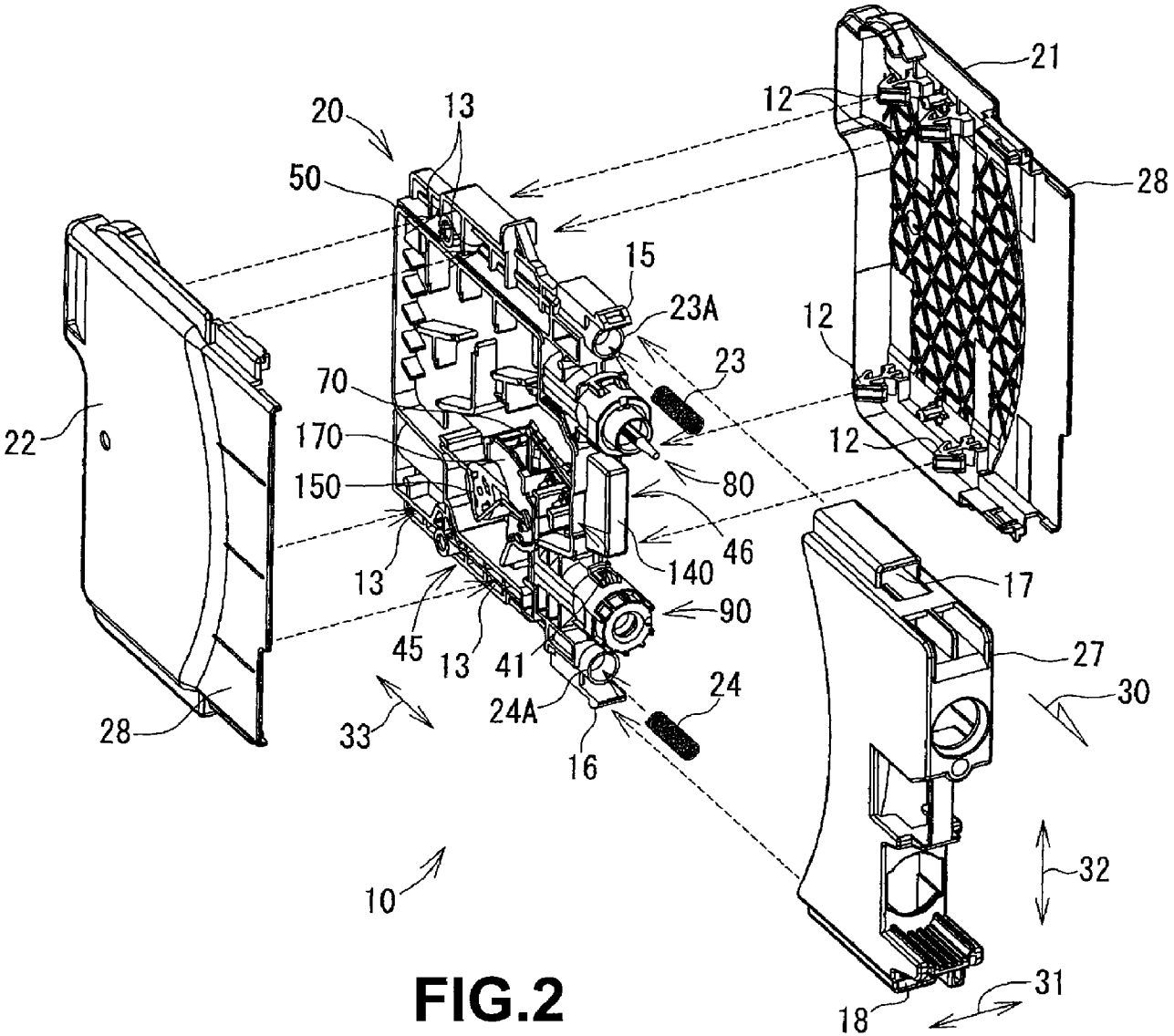
FIG. 2 is an exploded, perspective view of the ink cartridge of FIGS. 1(A) and 1(B).

The ink cartridge 10 may have a substantially flat hexahedron shape, e.g., a substantially rectangular parallelepiped shape, and may be more narrow in a widthwise direction, as indicated by an arrow 31, than in a height direction, as indicated by an arrow 32, and a depth direction, as indicated by an arrow 33. Referring to FIGS. 1(A)-2, the ink cartridge 10 may comprise an ink container 20, a case, e.g., a housing 26, a movable member, e.g., a slider 27, and a pair of coil springs 23 and 24, in which the housing 26 and the slider 27 may form an outer shell of the ink cartridge 10. The ink container 20 may comprise a frame 50, an air communication valve 80, and an ink supply valve 90.

The housing 26 may be configured to protect the ink container 20. For example, each portion of the ink container 20 other than a front surface 41 may be covered by the housing 26. The housing 26 may comprise a first cover 21 and a second cover 22 configured to enclose the ink container 20. The first cover 21 may be attached to a right side surface 46 of the ink container 20 via a plurality of engaging claws 12 positioned on the inner surface of the first cover 21, which engage engaging grooves 13 positioned on the ink container 20. Accordingly the right side surface 46 of the ink container 20 is covered by the first cover 21. Similarly, the second cover 22 is attached to a left side surface 45 of the ink container 20, such that the left side surface 45 of the ink container 20 is covered by he second cover 22. The covers 21 and 22 may have a shape which allows covers 21 and 22 to avoid interfering with the frame 50, the air communication valve 80, and the ink supply valve 90.

The slider 27 may be configured to protect the air communication valve 80 and the ink supply valve 90. The slider 27 may be removably attached to the ink container 20, and an inner surface of the slider 27 may contact the coil springs 23 and 24. The coil spring 23 may be mounted to a spring receiver 23A formed at the upper portion of the front surface 41 of the ink container 20, the coil spring 24 may be mounted to a spring receiver 24A formed at the bottom portion of the front surface 41, and the engaging claws 15 and 16 may engage a pair of engaging grooves 17 and 18, respectively, positioned on the slider 27, such that a front portion 28 of the housing 26 is covered by the slider 27.

Figure 3A:
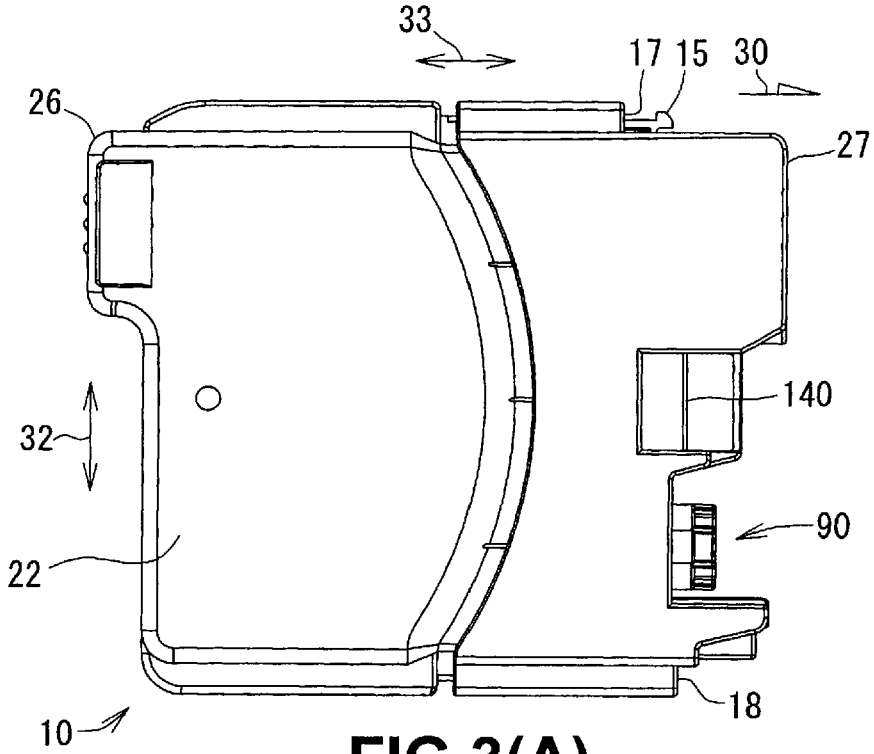
FIG. 3 is a side view of the ink cartridge of FIGS. 1(A) and 1(B).
Figure 3B:
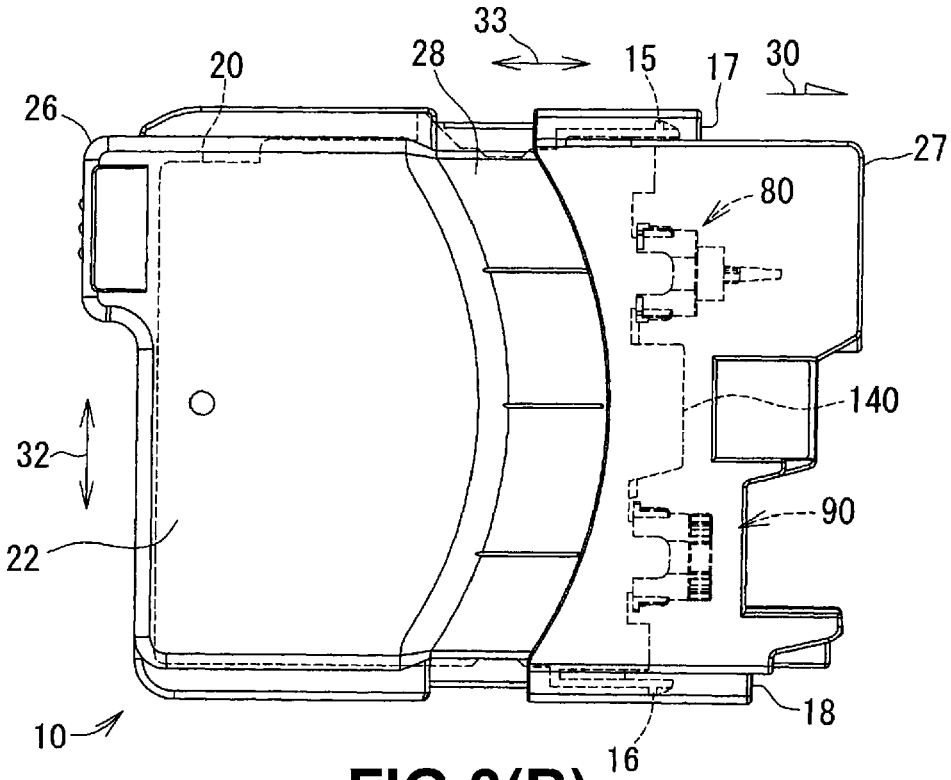
Figure 4:
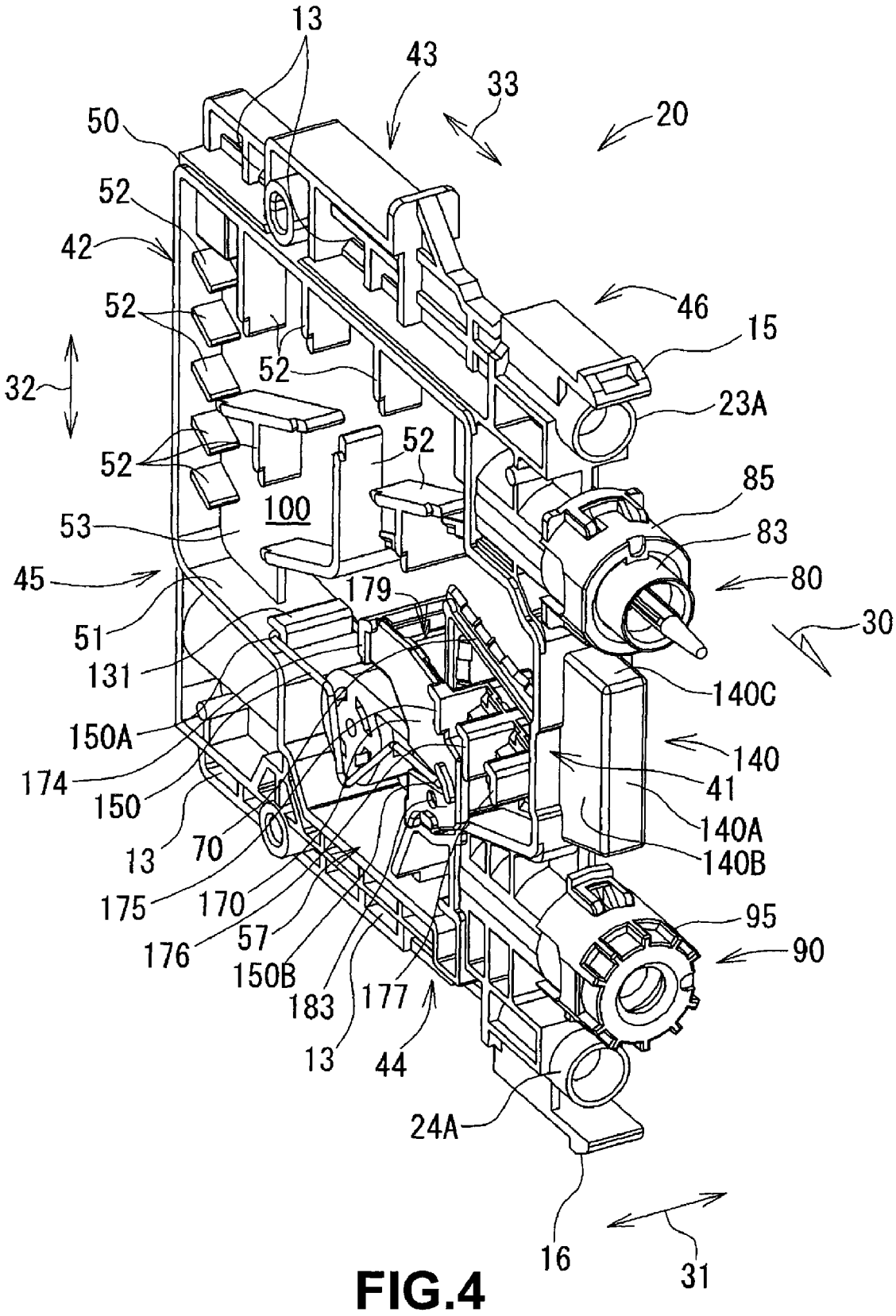
FIG. 4 is an enlarged, perspective view of an ink container, according to an embodiment of the present invention.

The slider 27 may be configured to slide in the depth direction along the front portion 28 of the housing 26. Referring to FIGS. 3(A) and 3(B), slider 27 may be configured to move between a first position, as shown in FIG. 3(B), and a second position, as shown in FIG. 3(A). When the slider 27 is in the first position, the slider 27 may be positioned further from the front surface 41 than when the slider 27 is in the second position. When the slider 27 is in the second position, the air intake valve 80 and the ink supply valve 90 may be exposed to the outside via a pair of openings formed in the slider 27, when the slider 27 is in the first position, the slider 27 may enclose the air communication valve 80 and the ink supply valve 90.

Referring to FIGS. 4-9, the ink container 20 may have substantially the same contour and shape as the ink cartridge 10. When the ink cartridge 10 is mounted to a cartridge storage section (not shown) of the recording apparatus, the cartridge storage section may receive the ink container 20 with the slider 27 in the second position. In this embodiment, the ink container 20 may comprise front surface 41, a rear surface 42 opposite the front surface 41, an upper surface 43, a lower surface 44 opposite the upper surface 43, a left side surface 45, and a right side surface 46 opposite the left side surface 45, such that surfaces 41-46 define an enclosure therein. An area of surfaces 45 and 46 may be greater than an area of each of surfaces 41-44.

The ink container 20 may comprise frame 50, an arm 70, a supporting block 170, a protecting member 150, the air communication valve 80, the ink supply valve 90, and at least one film 65, e.g., a pair of films 65. The frame 50 may be a housing of the ink container 20 which defines surfaces 41-46. The frame 50 may comprise a translucent resin, e.g., a transparent resin, and may be formed by injection molding. For example, the frame 50 may comprise polypropylene, polyacetal, nylon, or the like, or any combinations thereof.

The frame 50 may comprise an outer peripheral wall 51 and a plurality of inner walls 52. The inner walls 52 are arranged inside the outer peripheral wall 51. The outer peripheral wall 51 and the inner walls 52 may be integral with the frame 50. The outer peripheral wall 51 and the inner walls 52 may extend from the left side surface 45 to the right side surface 46 of the ink container 20. The outer peripheral wall 51 may be disposed in an annular shape along the front surface 41, the upper surface 43, the rear surface 42 and the lower surface 44 to define a space in the interior thereof. Accordingly, an opening 57 may be positioned on each of the left side surface 45 and the right side surface 46 of the frame 50.

The pair of films 65, e.g., translucent films, may be connected to, e.g., adhered to the left side surface 45 and the right side surface 46, respectively, of the frame 50 via an adhesion method, e.g., a thermal adhesion method. More specifically, the films 65 are adhered to both end portions of the outer peripheral wall 51 in the widthwise direction 31. Accordingly, the openings 57 are covered by the films 65, and a space surrounded by the outer peripheral wall 51 and the films 65 is defined as an ink chamber 100. Alternatively, a box-shaped frame which is opened on one side only may be employed instead of the frame 50. In this case, the ink chamber 100 is defined by the film 65 adhered on the opened side of the box shaped frame.

The inner walls 52 may be surrounded by the outer peripheral wall 51. The frame 50 may comprise a partitioning panel 53 which partitions an upper space of the ink chamber 100 at the center in the widthwise direction 31 integrally with the outer peripheral wall 51. The inner walls 52 may be integral with the outer peripheral wall 51 or the partitioning panel 53. The films 65 may be adhered to the inner walls 52 at the both end portions in the widthwise direction 31. Accordingly, inward deformation of the films 65 may be prevented or suppressed. Moreover, although the first cover 21 and the second cover 22 may deform toward the ink container 20, deformation of the first cover 21 and the second cover 22 may be prevented or suppressed by the inner walls 52. Consequently, the ink container 20 and the films 65 may not be damaged. The lower portion of the ink chamber 100, e.g., a space 102, below the partitioning panel 53 may not be partitioned in the widthwise direction 31.

The film 65 may comprise a plurality of synthetic resin films and may have a multilayer structure. For example, the film 65 may have a three-layer structure having a first layer comprising polypropylene, a second layer comprising nylon, and a third layer comprising polyethylene terephthalate laminated, such that the first layer on the side of the ink chamber 100 may comprise the same material as the frame 50. Alternatively, the films 65 may comprise a pulp, a metal, a natural resin, or the like.

A bearing plate 74 may be positioned at the center of the outer peripheral wall 51 in the widthwise direction and may protrude therefrom. The bearing plate 74 may be positioned at the outer peripheral wall 51 adjacent to a corner defined by the front surface 41 and the lower surface 44. The bearing plate 74 may be positioned at the end portion in the outer peripheral wall 51 on the side of the right side surface 46, and may protrude therefrom. The bearing plate 74 may have a bearing 67, e.g., a circular bearing, positioned on the surface thereof on the side of the left side surface 45. A shaft 77, e.g., a shaft having a column shape, may be fitted to the bearing 67, and a shaft opening 78 of the arm 70 may be fitted on the shaft 77. The other end of the shaft 77 is supported by the supporting block 170.

An ink injection portion 105 may be positioned at the rear surface 42 of the frame 50. The ink injection portion 105 may have a circular hole formed therethrough, which may allow fluid communicate between the rear surface 42 and the ink chamber 100. The ink injection portion 105 may be integral with the frame 50 adjacent to the lower end of the rear surface 42. The ink injection portion 105 communicates with the ink chamber 100. Ink is injected into the ink chamber 100 through the ink injection portion 105. In an embodiment, a pressure-reducing injection method of injecting ink may be employed for preventing generation of air bubbles in the ink chamber 100 by increasing the degree of deaeration in the ink chamber 100. More specifically, air in the ink chamber 100 may be removed before injecting ink into the ink chamber 100 to decrease the pressure in the ink chamber 100 to a pressure close to a vacuum pressure, and then ink may be injected in the ink chamber 100 using the pressure differential between the interior and the exterior thereof. After the ink is injected, the pressure in the ink chamber 100 is maintained at a pressure slightly lower than the atmospheric pressure. When ink is injected into the ink chamber 100, the pressure in the ink chamber 100 may be maintained at a pressure which is less than the atmospheric pressure, such that the films 65 are urged to deform toward the ink chamber 100 due to the pressure differential between the interior and the exterior of the ink chamber 100. Nevertheless, the supporting block 170 may prevent the films 65 from deforming toward the ink chamber 100.

The front surface 41 of the frame 50 may have a translucent portion 140 extending therefrom. The translucent portion 140 may be used to detect the amount of ink stored in the ink chamber 100. The translucent portion 140 may be integral with the frame 50, and may comprise the same material as the frame 50. The translucent portion 140 may be irradiated with light by an optical sensor, such as a photo interrupter, attached to the recording apparatus. The optical sensor has a light-emitting element and a light-receiving element. In this embodiment, the side wall 140B may be irradiated with light emitted from the light-emitting element, and light which passes through the side wall 140B may be received by the light-receiving element.

The translucent portion 140 may protrude outward from a portion of the front surface 41 adjacent to the middle portion thereof. The translucent portion 140 may be defined by five wall surfaces forming a substantially rectangular shape, and the space 142 may correspond to an interior thereof, and may have a hollow rectangular box shape. For example, the translucent portion 140 may be defined by a front wall 140A extending in parallel to the front surface 41, a pair of side walls 140B, an upper wall 140C, and a bottom wall 140D including. The width of the front wall 140A may be less than the width of the front surface 41. Moreover, the space 142 may be in fluid communication with the ink chamber 100.

The air communication valve 80 may be positioned above the translucent portion 140. The air communication valve 80 may be configured to selectively open and close a through hole 81 to allow fluid communication with the atmosphere positioned on the upper portion of the front surface 41. The air communication valve 80 may comprise a valve body 87, a spring 86, a sealing member 83, and a cap 85. The air communication valve 80 may close the through hole 81 when the ink cartridge 10 is not mounted to the recording apparatus, and may open the through hole 81 when mounted to the recording apparatus. As such, the pressure of an air layer in the ink chamber 100 is equalized with the atmospheric pressure. Alternatively, the air communication valve 80 may be replaced by a vinyl adhesive tape or film.

The ink supply valve 90 may be positioned below the translucent portion 140. The ink supply valve 90 may be configured to selectively open and close a through hole 91 to allow ink to be dispensed from an interior of ink chamber 100 to an exterior of ink chamber 100. The ink supply valve 90 may comprise a valve body 97, a spring 96, a spring receiver 94, a sealing member 93, and a cap 95. The ink supply valve 90 may close the through hole 91 when the ink cartridge 10 is not mounted to the recording apparatus, and may open the through hole 91 when the ink cartridge 10 is mounted to the recording apparatus and an ink needle (not shown) applies a force to the ink supply valve 90, such that ink in the ink chamber 100 may be dispensed from the ink chamber 100 to the recording apparatus through the ink needle.

The arm 70 may be used to determine the amount of ink stored in the ink chamber 100 is greater than a predetermined amount of ink. The arm 70 may comprise an indicator portion 72 which may be positioned at a first end of the arm 70. The indicator portion 72 may be configured to be positioned within the inner space 142 or outside the inner space 142 based on the amount of ink in the ink chamber 100. The arm 70 also may comprise a float portion 73 positioned at a second end of the arm 70.

The arm 70 may have a shaft hole 78 formed therethrough at substantially a center thereof. The shaft 77 may be inserted into the shaft hole 78. The shaft 77 may be configured to rotatably support the arm 70, and may be supported by the bearing 67 positioned on the bearing plate 74 at a first end thereof, and by the supporting block 170 at second end thereof. The arm 70 may be rotatably supported by the shaft 77 to be pivotable in the first direction and the second direction, which is perpendicular to the widthwise direction. The shaft 77 may be separate from or integral with the arm 70.

The interior of the float portion 73 may be hollow, and may float on ink. Alternatively, the float portion 73 may have a specific gravity which is less than the specific gravity of ink. Therefore, the float portion 73 may be displaced upward when a level of the ink in the chamber 100 is reduced to be lower than a predetermined ink level, and the arm 70 rotates in accordance with the movement of the float portion 73. In this embodiment, the float portion 73 may be configured to allow a second portion 76 from the shaft hole 78 to the float portion 73 float in the ink.

Figure 5:
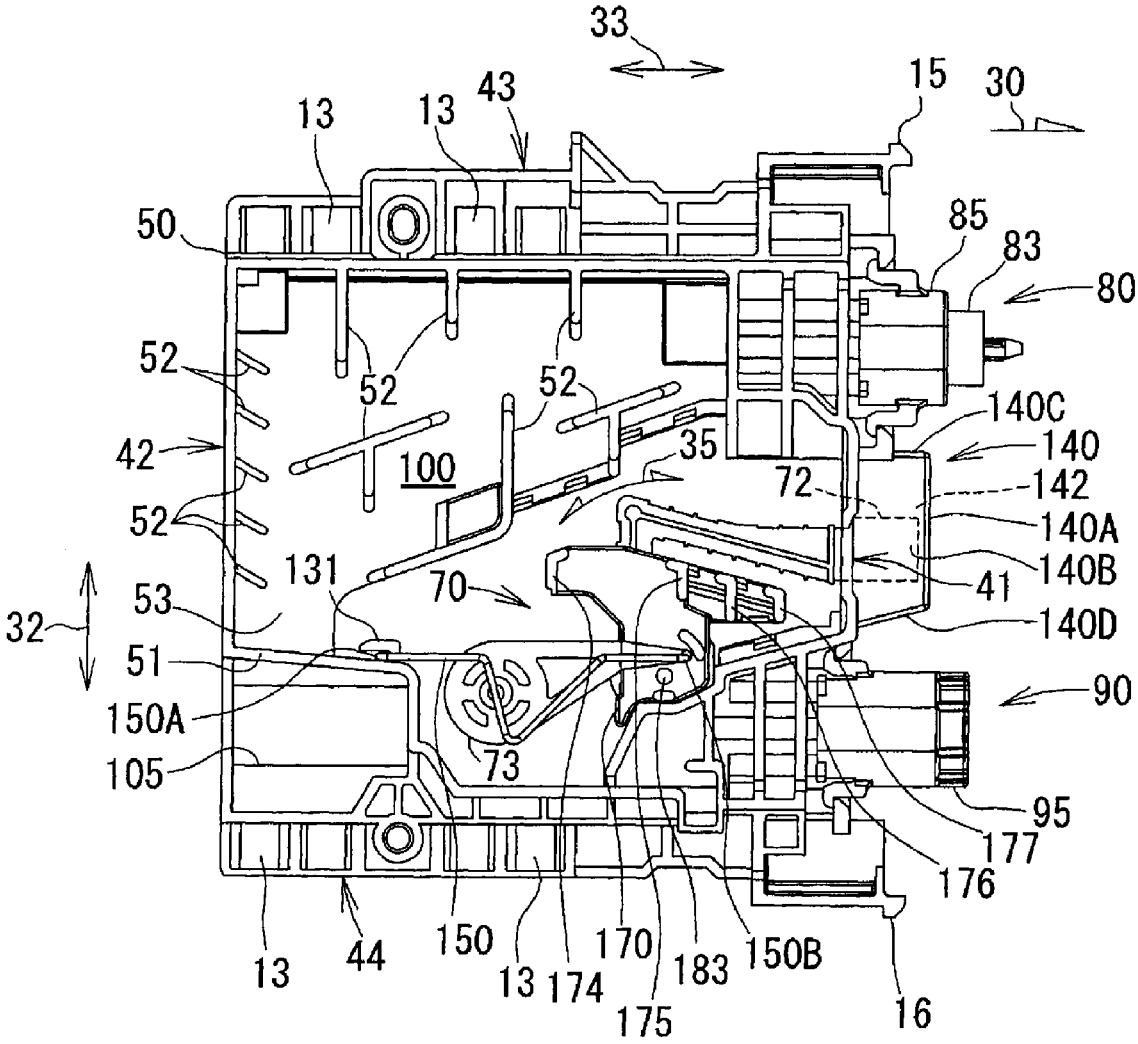
FIG. 5 is a side view of the ink container of FIG. 4.

The indicator portion 72 may be configured to indicate whether the amount of ink remaining in the ink chamber 100 is less than a sufficient amount of ink. When the arm 70 is rotated clockwise as shown in FIG. 5, the indicator portion 72 moves into the space 142 of the translucent portion 140. The indicator portion 72 which may contact the inner surface of the bottom wall 140D of the translucent portion 140 to prevent the further rotation thereof, and to position the arm 70 in a first position. When the arm 70 is rotated counterclockwise in FIG. 5, the indicator portion 72 moves away from the bottom wall 140D toward a second position.

In this embodiment, the second portion 76 may have a weight which is greater than a weight of a first portion 75 extending from the shaft hole 78 toward the indicator portion 72, such that in the air, the second portion 76 is heavier than the first portion 75. Consequently, when the amount of ink within the ink chamber 100 is relatively low, the arm 70 rotates counterclockwise in FIG. 5 about the shaft 77, and the indicator portion 72 moves out of the space 142 of the translucent portion 140 to indicate that the amount of ink in the ink chamber 100 is less than a sufficient amount of ink.

When the float portion 73 is positioned in the ink, a buoyancy is generated at the float portion 73, such that the arm 70 rotates clockwise in FIG. 5 about the shaft 77, and the indicator portion 72 moves into the space 142 of the translucent portion 140 and is positioned at the first position, which indicates that the amount of ink in the ink chamber 100 is greater than the predetermined amount of ink. Alternatively, the 70 may be replaced by a floating member (not shown) to provide an indication as to whether the amount of ink in the ink chamber is greater than a sufficient amount of ink.

In an embodiment, the protecting member 150 may be attached around the arm 70. The protecting member 150 may be fabricated by bending a linear steel member, such as a wire or a line. The protecting member 150 may comprise a U-shaped portion 150A, and may be fixed to the frame 50 by engaging the U-shaped portion 150A with a hook 131 positioned on the frame 50 and inserting an end portion 150B of the protecting member 150 into a hole (not shown) positioned on the bearing plate 74 and a hole 183 positioned on the supporting block 170.

Figure 6:
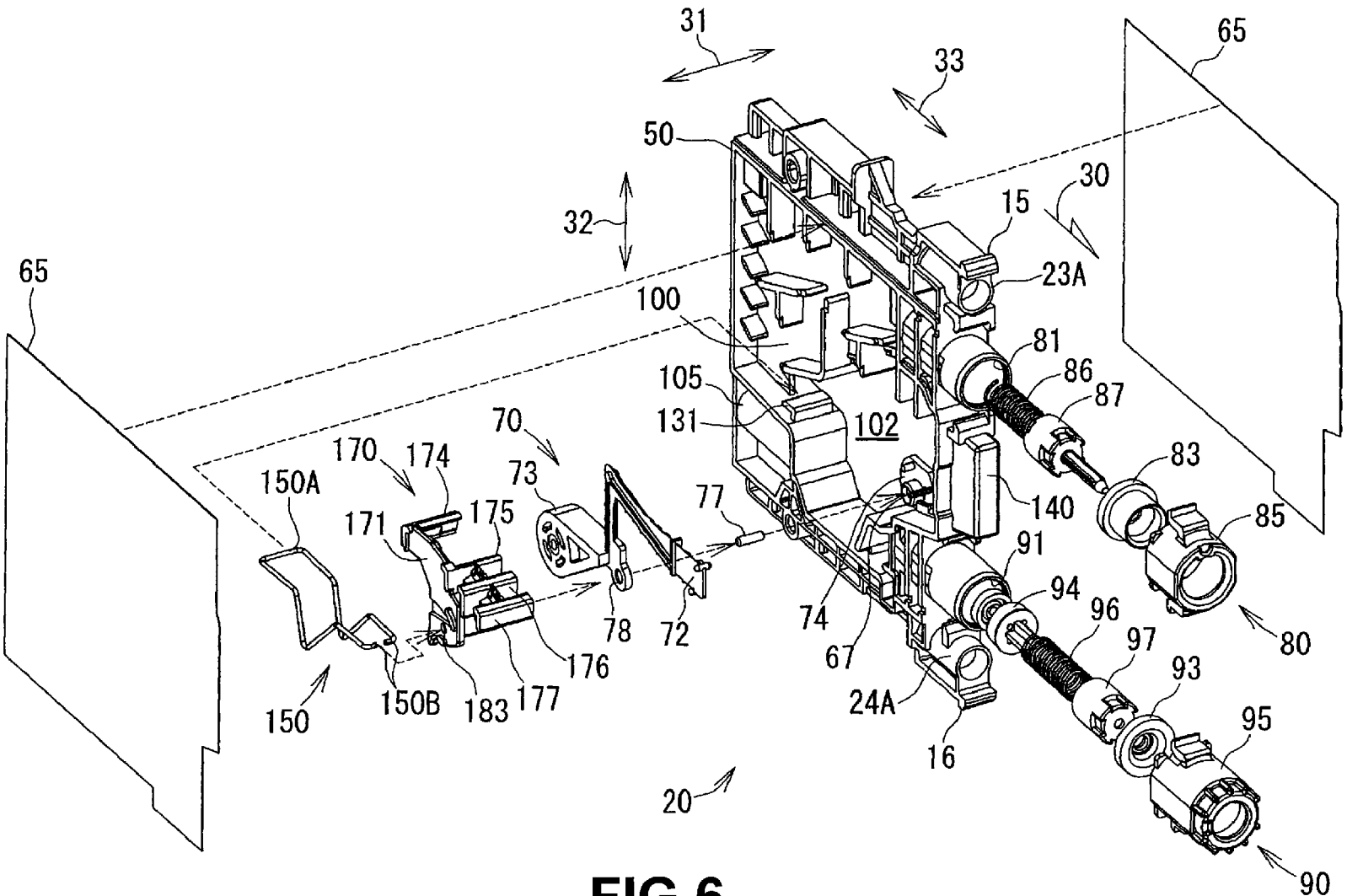
FIG. 6 is an exploded, perspective view of the ink container of FIG. 4.
Figure 7:
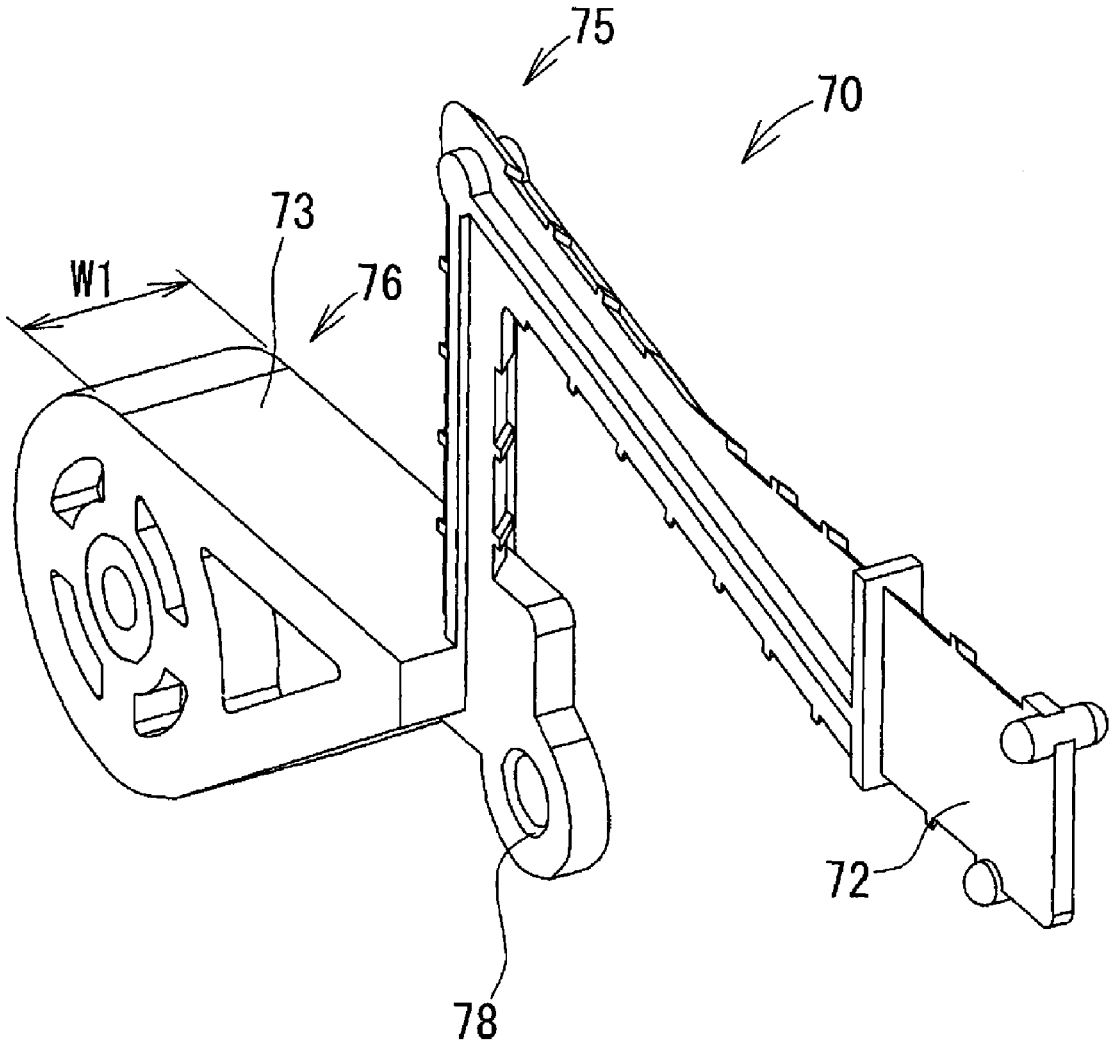
FIG. 7 is a perspective view of an arm, according to an embodiment of the present invention.
Figure 8:
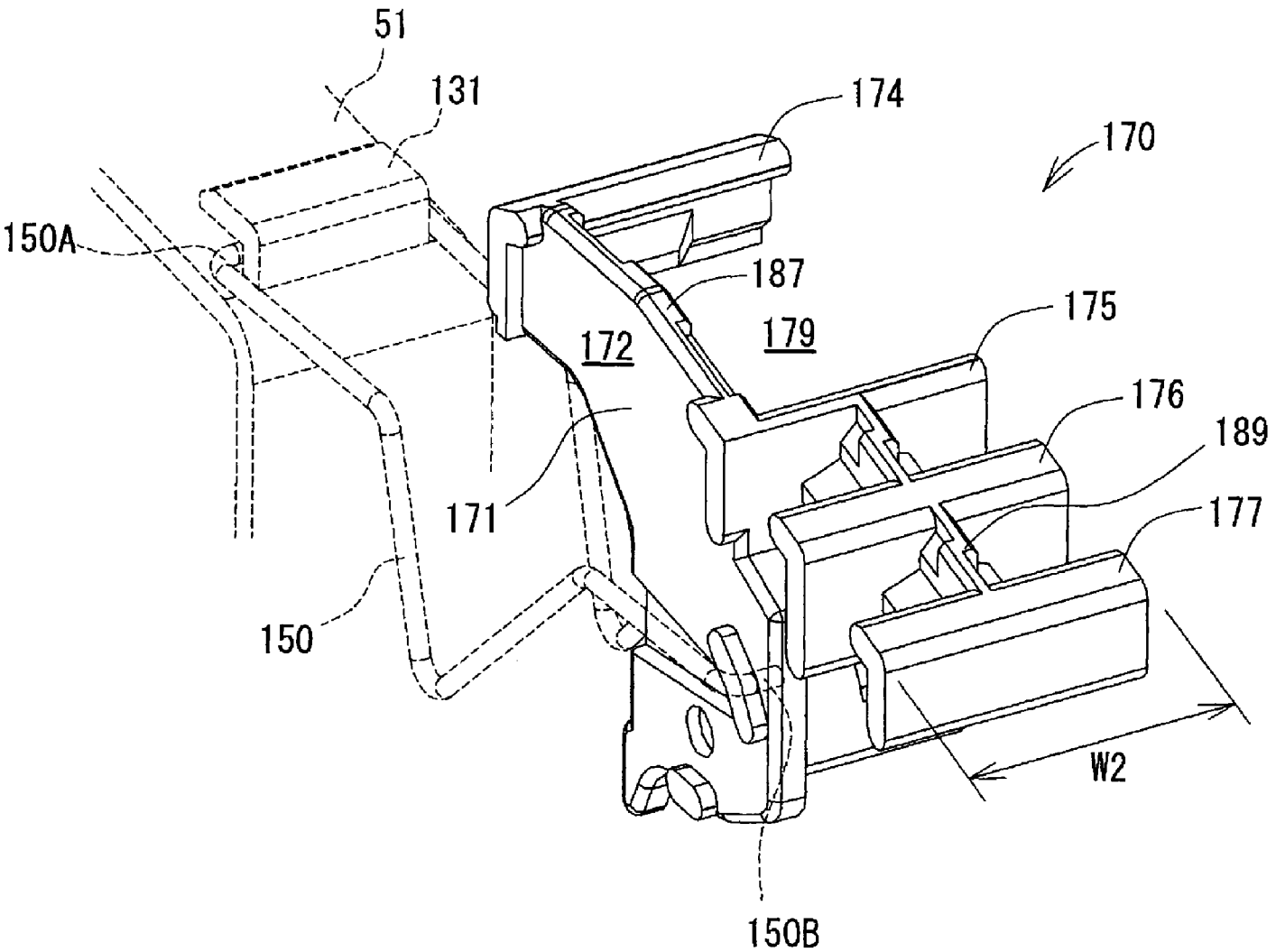
FIG. 8 is a perspective view of a supporting block, according to an embodiment of the present invention.
Figure 9D:
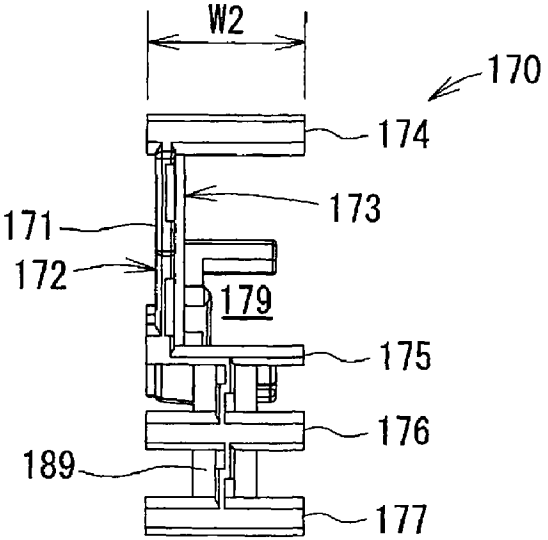
FIGS. 9(A)-9(D) are a front view, a left side view, a right side view, and a plan view of the supporting block of FIG. 8.
Figure 9C:
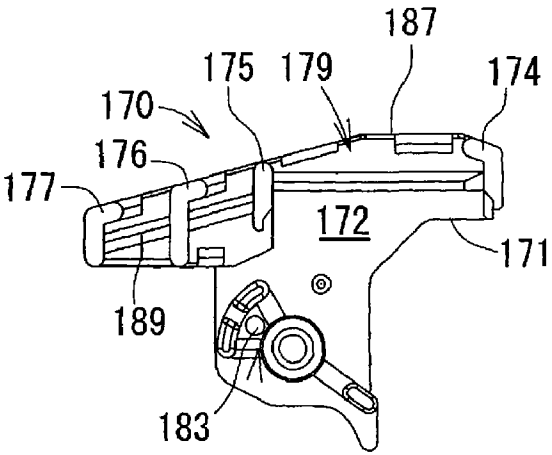
Figure 9A:
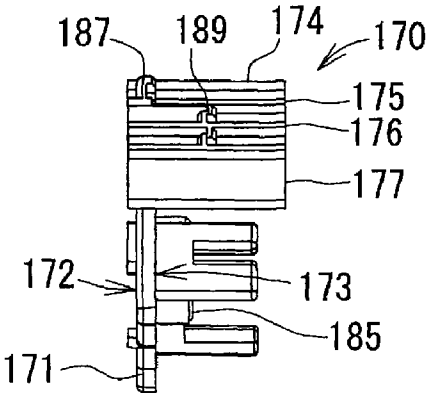
Figure 9B:
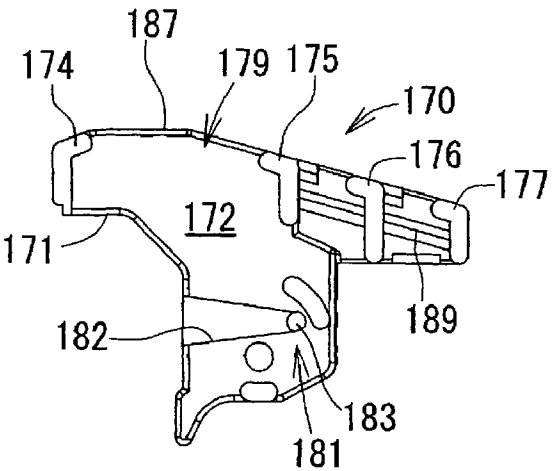

Referring to FIGS. 6, 8, and 9, the supporting block 170 may be configured to support the shaft 77 and the films 65, such that the support block 170 may prevent the films 165 from deforming inwardly, which may maximize a storage capacity of the ink chamber 100. The supporting block 170 may be positioned at the lower portion of the ink chamber 100 in the space 102, and may be configured to be removably mounted from the frame 50.

The supporting block 170 may comprise a plate and a plurality of ribs 174-177. The plate 171 and the ribs 174 to 177 may be integral and may comprise the same material as the frame 50. The rib 174 and the rib 175 may be positioned on a first surface 172 of the plate 171 and may protrude in the vertical direction. The ribs 174 and 175 may have an L-shape.

The rib 174 and the rib 175 may be positioned adjacent to an upper end 187 of the plate 171. In this embodiment, the rib 174 and the rib 175 may be separated and may define an opening 179 therebetween, e.g., a substantially C-shaped opening. In this embodiment, the first portion 75 of the arm 70 may be inserted into the opening 179, such that the arm 70 is pivotable or movable within the range of the opening 179.

The supporting block 170 may have a supporting portion 189 extending from the rib 175 substantially in the horizontal direction. The supporting portion 189 may extend from a substantially center portion of the rib 175 in the direction opposite to the rib 174. The supporting portion 189 may be provided with the rib 176 and the rib 177. The rib 176 and the rib 177 may be separated from each other to be positioned dispersedly in the space 102.

The rib 176 and the rib 177 may have substantially an L-shape. In this embodiment, the ribs 176 and 177 may extend in the same direction and may have the same length as the ribs 174 and 175 with the intermediary of the supporting portion 189.

The width W2 of the ribs 174-177 may be a width which prevents or substantially prevents the films 65 from contacting the arm 70 when the films 65 are urged to deform inwardly and toward the ink chamber 100. For example, the width W2 may be greater than the width W1 of the float portion 73, which may be portion of the arm 70 having the greatest length in the widthwise direction. In an embodiment, the width W2 may be substantially equal to the width of the plate 171.

In an embodiment, a groove 182 may be positioned at the lower portion of the first surface 172 of the plate 172. The groove 182 may have a substantially triangular shape and may extend transversely. The groove 182 may have a hole 183 formed therethrough at an apex 181 thereof. When the end portion 150B of the protecting member 150 is pushed along the groove 182 toward the apex 181 with the supporting block 170 disposed in the space 102, the end portion 150B may be guided to the apex 181, and may be inserted into the hole 183. Accordingly, the operation to insert the end portion 150B of the protecting member 150 into the hole 183 readily may be facilitated.

A second surface 173 of the plate 172 may have a bearing 185 in which a first of the ends of the shaft 77 is fitted. When the supporting block 170 is fitted to the bearing plate 74 from the side of the second surface 173, such that the bearing 185 and a second end of the shaft 77 are aligned with each other with the shaft hole 78 of the arm 70 inserted into the shaft 77, the bearing 185 may be fitted to the second end of the shaft 77. Consequently, the arm 70 may be pivotably supported, and the supporting block 170 may be attached to the plate 50. The first portion 75 of the arm 70 then may be inserted into the opening 179, and the ribs 174-177 may be arranged vertically with respect to the left side surface 45 and the right side surface 46 and the supporting block 170 may be attached to the plate 50.

While the invention has been described in connection with exemplary embodiments, it will be understood by those skilled in the art that other variations and modifications of the exemplary embodiments described above may be made without departing from the scope of the invention. Other embodiments will be apparent to those skilled in the art from a consideration of the specification or practice of the invention disclosed herein. It is intended that the specification and the described examples are considered merely as exemplary of the invention, with the true scope of the invention being indicated by the flowing claims.

What is claimed is:

1. An ink cartridge comprising:

a frame;

at least one film connected to at least a portion of the frame, wherein the frame and the at least one film define an ink chamber therein, and the ink chamber is configured to store ink therein;

a supporting member configured to support the at least one film; and a movable member pivotably coupled to the supporting member, wherein the movable member is configured to selectively move within the ink chamber in a first direction and in a second direction opposite the first direction based on an amount of ink within the ink chamber, and the supporting member, the movable member, and the at least one film are aligned in a particular direction which is perpendicular to the first direction and to the second direction, wherein the supporting member has an opening formed therein, and a portion of the movable member is accommodated within the opening.

2. The ink cartridge of claim 1, wherein the supporting member comprises a shaft, and the movable member is connected to the shaft and is configured to pivot about the shaft.

3. The ink cartridge of claim 2, wherein the supporting member further comprises at least one plate, and the shaft is connected to the at least one plate.

4. The ink cartridge of claim 3, wherein the supporting member further comprises a plurality of ribs extending from the at least one plate, wherein a first of the plurality of ribs and a second of the plurality of ribs define a space therebetween, and a portion of the movable member is positioned within the space and is configured to pivot within the space, wherein at least a portion of the plurality of ribs are configured to support the at least one film.

5. The ink cartridge of claim 4, wherein the plurality of ribs extend from the at least one plate in the particular direction, and a width of at least a portion of the movable member in the particular direction is less than a width of the plurality of ribs in the particular direction.

6. The ink cartridge of claim 5, wherein a width of each portion of the movable member in the particular direction is less than the width of the plurality of ribs in the particular direction.

7. The ink cartridge of claim 1, wherein the movable member comprises:

an arm having a first end and a second end opposite the first end; and a float portion positioned at the second end of the arm, wherein the arm is pivotally coupled to the supporting member between the first end and the second end of the arm.

8. The ink cartridge of claim 1, wherein the film comprises a multilayer synthetic resin.

9. The ink cartridge of the claim 1, further comprising:

an ink container configured to store ink in the ink chamber; and at least one cover configured to substantially cover the ink container.

* * * * *